United States Patent [19]

Wiech, Jr.

[11] Patent Number: 4,602,953

[45] Date of Patent: Jul. 29, 1986

[54] PARTICULATE MATERIAL FEEDSTOCK, USE OF SAID FEEDSTOCK AND PRODUCT

[75] Inventor: Raymond E. Wiech, Jr., San Diego, Calif.

[73] Assignee: Fine Particle Technology Corp., Camarillo, Calif.

[21] Appl. No.: 711,265

[22] Filed: Mar. 13, 1985

[51] Int. Cl.[4] ..... B22F 1/00

[52] U.S. Cl. ..... 75/228; 75/245; 75/246; 75/251; 75/252; 264/63; 264/125; 264/332; 419/7; 419/10; 419/23; 419/37; 419/38; 419/65; 419/66; 501/1

[58] Field of Search ..... 419/7, 23, 10, 38, 37, 419/65, 66; 75/228, 245, 246, 251, 252; 264/63, 125, 332; 501/1

[56] References Cited

U.S. PATENT DOCUMENTS

| | | | |
|---|---|---|---|
| 4,305,756 | 12/1981 | Wiech | 419/36 |
| 4,404,166 | 9/1983 | Wiech | 419/37 |
| 4,415,528 | 11/1983 | Wiech | 419/36 |
| 4,432,795 | 2/1984 | Andersen | 419/23 |
| 4,445,936 | 5/1984 | Wiech | 419/36 |

*Primary Examiner*—Stephen J. Lechert, Jr.
*Attorney, Agent, or Firm*—Jay M. Cantor

[57] ABSTRACT

The disclosure relates to a feedstock of particulate material for use in formation of articles therefrom, the feedstock including a homogeneous combination of large particles, small particles and a binder. The large particles comprise less than about 60% by volume of the feedstock and are defined as particles having a diameter greater than their diffusion length. The fine particles and binder combined comprise more than about 40% by volume of the feedstock, the fine particles being defined as particles having a diameter less than their diffusion length.

42 Claims, No Drawings

PARTICULATE MATERIAL FEEDSTOCK, USE OF SAID FEEDSTOCK AND PRODUCT

BACKGROUND OF THE INVENTION

1. Field of the Invention

This invention relates to a method of making feedstock for the formation of articles from fine particles and to the article itself.

2. Brief Description of the Prior Art

In the prior art procedures for formation of articles from powdered metals, two distinct approaches have been taken, the older approach being that of press and sinter and the more recent approach being that of molding, debinding and sintering of a thermoplastic feedstock containing small particles or aggregate and a binder. Examples of the latter procedures are set forth in U.S. Pat. Nos. 2,939,199 (Strivens), 4,197,118 (Wiech), 4,404,166 (Wiech), and 4,445,936 (Wiech) and Canadian Pat. No. 1,177,290 (Wiech). In order to achieve high sinter densities and high sinterability using the more recent technology described above, it has been necessary to utilize fine particles on the order of about 4 microns which have been blended with a thermoplastic binder as the feedstock material. After formation of the green article, the binder was removed and, by well known sintering relationships, the material could achieve a high final fired density with its attendant excellent properties of tensile strength and high elongations. The drawback with the use of fine particles, however, is that they tend to be very expensive as opposed to the much larger diameter particles employed in conventional powder metallurgy of the press and sinter type. It has therefore been an objective in the art to provide feedstock materials that have substantially the same molding and sintering properties as the fine particle feed stock meterials, yet which are more comparable in cost to the less expensive large particulate materials used in the press and sinter technology. These large particle size materials cannot presently be used successfully in the above described more recent technology.

The properties of thermoplastic molding feedstock materials are such that, during the green formation phase, the green feedstock material must behave as if it were a well behaved thermoplastic material. It must then be readily debound and must, under conventional sintering practice, be sinterable to high density with a non-interconnecting porosity. The final material must have a high elongation and high mechanical properties, generally speaking, better than ninety percent of the properties of an equivalent forged material. In the prior art, this has been attained by utilizing particles with diameters on the order of twenty-five percent of the diffusion length of the various chemical species that are involved in the sintering phenomenon. Efforts have been made to employ larger diameter particles by using the conventional concepts found in ceramic technology and powdered metallurgy of distributing particle sizes to maximize the green feedstock density of classifying the particles so that the smaller particles fit into the interstices of the larger particles. While this approach has demonstrated that a high engineering property material in ceramics and powdered metallurgy can be attained, it has been most successful in those systems in which the entire sintering forces are due to the free surface energy forces on the particles.

The prior art densification forces in compact and sinter powder metallurgy are those mechanical forces that collapse the particulate field together by mechanically yielding the particles and in which sintering serves only to weld the particles together. This result is because the particle sizes present in classical powder metallurgical applications cause the particle to particle diffusion field to be far less than the particle diameter. This causes the particles to weld together but does not achieve any substantial densification, i.e., the centers of the particles moving closer to each other by an exchange of material between the particles.

When particulate fields with particles that are about 25% of the diffusion length of the active diffusing chemical species are used, especially in metals though not limited to metals, solid state diffusion utilizing only the free surface energy of the particles as a driving force behind diffusion results in very high engineering property materials. This technique is currently being carried but on a commercial basis and is well known in the art as demonstrated in the above noted patents. A drawback to this technique, however, is that the cost of a given weight quantity of powder that has a very fine particle size with a very narrow particle size distribution is very costly when compared to the much larger particle sizes which are utilized in powdered metal technology of the press and sinter or compact and sinter type. The particle sizes that are presently employed for fine metal powders are approximately 4 microns in diameter with a distribution such that there are few particles larger than about 5 microns and few smaller than about 2 microns. Ideally, it is desired to have all particles of exactly the same size, however, as one deviates therefrom, the final densities of the final article produced after debinding and sintering become lower and the mechanical properties developed become lower also. In addition, the elongation decreases and the tensile strength decreases. A preferred range for the final particle aggregate is 4 microns plus or minus about 50% or less.

SUMMARY OF THE INVENTION

The high cost of the raw material powder has been a limiting factor in the particulate material technology area of the type described above. It has been found that large particles may be included in the fine particulate feedstock formulations to an extent that dramatically reduces the overall cost of the feedstock material while minimally affecting its green and sintered properties. A fine particle is defined as follows: In a graph where the x-axis is $(c-c_o)/(c_s-c_o)$ and where the y-axis is $x/(Dt)^{\frac{1}{2}}$, those particles that have a y-value of less than about 0.5 when $x/(Dt)^{\frac{1}{2}}$ is equal to one or more, where c is concentration per unit volume, $c_o=c$ at time $(t)=0$ and $c_s=c$ at $x=0$ where x is the diffusion distance in the direction of diffusion, D is the diffusion coefficient and $x/(Dt)^{\frac{1}{2}}$ is a generalized solution to Fick's second law of diffusion. Concentration (c) is the amount of the diffusing species per unit volume at a given point. Particles that reside within the above described definition of fine particle in general have a maximum diameter of about 10 microns or less. This means that the entire particle participates in diffusion during the period of sintering wherein diffusion takes place. A large particle is defined as one in which the diffusion length of the chemical species during the sintering process is less than the diameter of the particle. This means that the entire large particle cannot participate in the diffusion during the period of diffusion. Therefore, the large particles tend to weld together rather than to diffuse into one unit as do the fine particles.

A group of large particles can be taken and dispersed into a group of fine powder particles in such a way as to keep the large particles separate from each other, (i.e., not touching each other), and to have a continuous fine particle field including binder that surrounds the large particles, where the fine particles are of substantially uniform size as described hereinabove to provide a feedstock material. The feedstock material is formed in the same manner as the 100% fine particle feedstock material of the prior art and, after debinding, can be sintered to a high density with excellent properties of tensile strength, elongation and the like, very similar to that of the 100% fine particle feedstock material.

As the size of the particles is reduced, the total free energy per unit volume due to the interfacial energy between particle and binder becomes greater and greater. Depending upon the exact magnitude of this free energy, the volume loading of particles into feedstock systems will progressively decrease with decreased particle size. Hence, a lower level practical limit of fine particle size is reached when the particle size is such that only about 45% by volume of the fine particles can be incorporated into the overall feedstock material, this being the maximum volume loading for this particular system. Fifty-five percent of the feedstock material will then be binder. This represents the minimum diameter of the particles that can be used in that particular feedstock system. In order to lower the cost of that feedstock system, large particles can be incorporated or dispersed into that system, large particles being those where the particle diameter is greater than the diffusion length thereof. It has been found that if large particles are introduced into a feedstock system which contains a maximum volume loading of fine particles by replacing up to about 60% by volume and preferrably 50% by volume of the fine particles with the same volume of large particles such that there are substantially no large particle to large particle contacts, that the system will behave from a debinderizing and sintering standpoint very nearly as if there were no large particles in the system. The final mechanical properties of this sintered material from the standpoint of elongation and tensile strength are almost equal to the same part made with all fine particles.

Upon debinding and sintering, the large particles act substantially as raisins in a pudding with the pudding itself diminishing in size while it is being sintered. The sintering forces at the large particle to small particle interfaces accommodate themselves in such a way that the sintering field is distorted at those points, the large particles retaining their size and the fine particulate field becoming smaller, thereby carrying the larger particles with them. Therefore, the shrinkage of the overall system is substantially the same as with the fine particles alone. It is preferrable to operate at about 50% large particles and 50% combined small particle and binder subsystem by volume. The ability to use more and more fine particles is available, this however increasing the cost of the feedstock system. It is therefore desirable to use the maximum amount of large particles. Since the large particles have a cost substantially less than that of the fine particles, it can be seen that the system using the large particles provides a substantial cost saving over the use of fine particles alone with minimal loss of engineering properties. A preferred large particle is a −325 mesh material which has particle sizes of 44 microns maximum and smaller particles including fine particles with an approximately 30 micron diameter average in the large particle system.

The feedstock in accordance with the present invention is formulated by mixing fine particles together with a binder and large particles in the desired amounts. The formulation is heated above the melting point of the total binder system and the formulation is mixed using, for example, a sigma blade mixer until a homogeneous mass is produced. The formulation is then cooled to permit solidification thereof and then broken up into small particles or pellets for feeding into a molding machine or the like.

The fine particles are any element, alloy or compound which can be molded and which are or can be made sinterable and include metals, some ceramics and most cermets. The particles are preferably spherical or as near spherical in shape as possible. The above described materials are all well known.

The large particles will normally have substantially the same chemical composition as the fine particles or will have a chemical composition preferably such that they will be converted to the chemical composition of the fine particles or vice versa during the article processing steps. Alternatively, the fine particles or both the fine particles and the large particles can be converted to a third chemical composition during the processing steps for formulation of an article.

Though it is preferred that the large and fine particles be of the same chemical composition after sintering, the possibility that their chemical composition be different is anticipated herein and made a part of the disclosure.

The binder can be of a single component or multiple components with different melting points. Such binder systems and binders are well known in the art and are disclosed in part in the above noted prior art. Crystalline binder materials are preferred.

DESCRIPTION OF THE PREFERRED EMBODIMENTS

A feedstock for use in the process of forming articles in the above noted patents of Raymond E. Wiech, Jr. was formulated as follows:

EXAMPLE I

Three hundred fifteen grams of substantially spherical nickel particulate material having an average particle size of four to seven microns and a specific surface area of 0.34 square meters per gram (Inco type 123 nickel powder) was mixed with three hundred fifteen grams of −325 mesh substantially spherical nickel particulate material and 35.2 grams of binder which included 7.0 grams of polypropylene which goes from the crystalline to the liquid state at about 150° C., 3.5 grams of carnauba wax having a melting point about 85° C. and 24.7 grams of paraffin having a melting point of about 50° C. The mixture was placed in a Hobart laboratory type mixer of 10 quart capacity and mixed at a temperature of 170° C. until the polypropylene incorporated itself into the mixture. The temperature was then lowered to 150° C. for one half hour while still mixing. A homogeneous, uniform and modest viscosity plastisole was formed. It was removed from the mixer, allowed to cool for an hour until the binder system had solidified. The hardened material was then broken up into small particles using a plastic grinder.

EXAMPLE II

A formulation was made exactly the same as in Example I with exactly the same equipment with the particulate material being changed from nickel to substantially spherical iron of average particle diameter of 4 to 6 microns of substantially spherical shape for the fine particles and −325 mesh iron for the large particles. In this example, 278.19 grams of fine particle iron was mixed with 278.19 grams of the −325 mesh iron and a binder system the same as in Example I.

It is readily apparent from the above that the feedstock system in accordance with the present invention can use approximately half as much binder in the case of the 50% large particle system as compared with prior art systems, thereby providing for decreased requirement of the ultimately disposed of portion of the feedstock system. In addition, since the amount of binder in the system is less than in the prior art system, the period required for debinding of the system can be substantially decreased and thereby provide substantially shorter run times for production of articles from the feedstock. The result of this is that there can be a substantial cost saving, not only in the particulate material system itself, but also in the article production procedures in which the feedstock system is to be utilized.

Though the invention has been described with respect to several preferred embodiments thereof, many variations and modifications will immediately become apparent to those skilled in the art. It is therefore the intention that the appended claims be interpreted as broadly as possible in view of the prior art to include all such variations and modifications.

I claim:

1. A homogeneous feedstock composition which comprises:

(a) a predetermined volume of sinterable fine particles of predetermined chemical species, (b) a predetermined volume of large particles of predetermined chemical species weldable to said fine particles; and (c) a predetermined amount of binder;

(d) the volume of the combination of said fine particles and said binder being greater than the volume of the interstices between said large particles when the large particles are in their most compacted form without mechanically deforming said large particles.

2. A feedstock composition as set forth in claim 1 wherein said fine particles and said binder in combination form at least about 40% by volume of said composition and said large particles form about 60% or less of the volume of said composition.

3. A feedstock composition as set forth in claim 1 wherein said fine particles and said binder in combination form about 50% by volume of said composition and said large particles form about 50% by volume of said composition.

4. A feedstock composition as set forth in claim 1 wherein said fine particles have a diffusion length greater than their diameters and said large particles having a diffusion length less than their diameters.

5. A feedstock composition as set forth in claim 2 wherein said fine particles have a diffusion length greater than their diameters and said large particles have a diffusion length less than their diameters.

6. A feedstock composition as set forth in claim 3 wherein said fine particles have a diffusion length greater than their diameters and said large particles have a diffusion length less than their diameters.

7. A feedstock composition as set forth in claim 1 wherein said fine particles have a diameter less than about ten microns.

8. A feedstock composition as set forth in claim 2 wherein said fine particles have a diameter less than about ten microns.

9. A feedstock composition as set forth in claim 3 wherein said fine particles have a diameter less than about ten microns.

10. A feedstock composition as set forth in claim 4 wherein said fine particles have a diameter less than about ten microns.

11. A feedstock composition as set forth in claim 5 wherein said fine particles have a diameter less than about ten microns.

12. A feedstock composition as set forth in claim 6 wherein said fine particles have a diameter less than about ten microns.

13. A feedstock composition as set forth in claim 4 wherein said large particles also have a diameter greater than ten microns.

14. A feedstock composition as set forth in claim 5 wherein said large particles also have a diameter greater than ten microns.

15. A feedstock composition as set forth in claim 6 wherein said large particles also have a diameter greater than ten microns.

16. A feedstock composition as set forth in claim 10 wherein said large particles also have a diameter greater than ten microns.

17. A feedstock composition as set forth in claim 11 wherein said large particles also have a diameter greater than ten microns.

18. A feedstock composition as set forth in claim 12 wherein said large particles also have a diameter greater than ten microns.

19. A feedstock composition as set forth in claim 1 wherein the chemical species of said fine particles is the same as the chemical species of said large particles.

20. A feedstock composition as set forth in claim 2 wherein the chemical species of said fine particles is the same as the chemical species of said large particles.

21. A feedstock composition as set forth in claim 3 wherein the chemical species of said fine particles is the same as the chemical species of said large particles.

22. A feedstock composition as set forth in claim 4 wherein the chemical species of said fine particles is the same as the chemical species of said large particles.

23. A feedstock composition as set forth in claim 5 wherein the chemical species of said fine particles is the same as the chemical species of said large particles.

24. A feedstock composition as set forth in claim 6 wherein the chemical species of said fine particles is the same as the chemical species of said large particles.

25. A feedstock composition as set forth in claim 7 wherein the chemical species of said fine particles is the same as the chemical species of said large particles.

26. A feedstock composition as set forth in claim 8 wherein the chemical species of said fine particles is the same as the chemical species of said large particles.

27. A feedstock composition as set forth in claim 9 wherein the chemical species of said fine particles is the same as the chemical species of said large particles.

28. A feedstock composition as set forth in claim 10 wherein the chemical species of said fine particles is the same as the chemical species of said large particles.

29. A feedstock composition as set forth in claim 11 wherein the chemical species of said fine particles is the same as the chemical species of said large particles.

30. A feedstock composition as set forth in claim 12 wherein the chemical species of said fine particles is the same as the chemical species of said large particles.

31. A feedstock composition as set forth in claim 13 wherein the chemical species of said fine particles is the same as the chemical species of said large particles.

32. A feedstock composition as set forth in claim 14 wherein the chemical species of said fine particles is the same as the chemical species of said large particles.

33. A feedstock composition as set forth in claim 15 wherein the chemical species of said fine particles is the same as the chemical species of said large particles.

34. A feedstock composition as set forth in claim 16 wherein the chemical species of said fine particles is the same as the chemical species of said large particles.

35. A feedstock composition as set forth in claim 17 wherein the chemical species of said fine particles is the same as the chemical species of said large particles.

36. A feedstock composition as set forth in claim 18 wherein the chemical species of said fine particles is the same as the chemical species of said large particles.

37. A feedstock composition as set forth in claim 1 wherein said chemical species of said fine particles comprises plural chemical components.

38. A feedstock composition as set forth in claim 18 wherein said chemical species of said fine particles comprises plural chemical components.

39. A feedstock composition as set forth in claim 19 wherein said chemical species of said fine particles comprises plural chemical components.

40. A feedstock composition as set forth in claim 36 wherein said chemical species of said fine particles comprises plural chemical components.

41. A method of producing an article from a fired particulate feedstock whereby binder is removed from the particulate feedstock prior to firing, comprising the steps of:

(a) providing a homogeneous feedstock comprising at least about forty percent by volume sinterable fine particles of predetermined chemical species, less than about sixty percent by volume of large particles of predetermined chemical species weldable to said fine particles and a predetermined amount of binder, the volume of the combination of said fine particles and said binder being greater than the volume of the interstices between said large particles when the large particles are in their most compacted form without mechanically deforming said large particles;

(b) forming said feedstock into a desired configuration;

(c) removing a predetermined amount of said binder from said configuration; and (d) sintering said configuration from which said binder has been removed to weld said large particles to said fine particles and diffuse said fine particles into each other.

42. The product of the process of claim 41.

* * * * *